US009935355B2

(12) United States Patent
Teng et al.

(10) Patent No.: US 9,935,355 B2
(45) Date of Patent: Apr. 3, 2018

(54) THZ PHOTOMIXER EMITTER AND METHOD

(75) Inventors: Jinghua Teng, Singapore (SG); Hendrix Tanoto, Singapore (SG); Qing Yang Steve Wu, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 0 days.

(21) Appl. No.: 13/881,921

(22) PCT Filed: Oct. 28, 2011

(86) PCT No.: PCT/SG2011/000379

§ 371 (c)(1),
(2), (4) Date: Jul. 17, 2013

(87) PCT Pub. No.: WO2012/057710

PCT Pub. Date: May 3, 2012

(65) Prior Publication Data

US 2013/0292586 A1 Nov. 7, 2013

Related U.S. Application Data

(60) Provisional application No. 61/408,099, filed on Oct. 29, 2010.

(51) Int. Cl.

| | |
|---|---|
| ***H01Q 1/00*** | (2006.01) |
| ***H01Q 9/16*** | (2006.01) |
| ***H01Q 9/27*** | (2006.01) |

(52) U.S. Cl.

CPC ..... *H01Q 1/00* (2013.01); *H01Q 9/16* (2013.01); *H01Q 9/27* (2013.01)

(58) Field of Classification Search

CPC ..... G01N 21/3581; H01Q 9/16; H01Q 1/00; H01Q 9/27; G02F 2203/13

(Continued)

(56) References Cited

U.S. PATENT DOCUMENTS 5,663,639 A * 9/1997 Brown ..... H01L 31/1085 250/214 A
6,348,683 B1 * 2/2002 Verghese ..... H01L 31/10 250/214.1

(Continued)

FOREIGN PATENT DOCUMENTS

| | | | |
|---|---|---|---|
| DE | 102006059573 | B3 | 3/2008 |
| DE | 102008031751 | B3 * | 8/2009 |
| EP | 2120291 | A1 | 11/2009 |

OTHER PUBLICATIONS

"International Application No. PCT/SG2011/000379, International Preliminary Report on Patentability dated Feb. 18, 2013", (dated Feb. 18, 2013), 9 pgs.

(Continued)

*Primary Examiner* — Wyatt Stoffa

(74) *Attorney, Agent, or Firm* — Schwegman Lundberg & Woessner, P.A.

(57) ABSTRACT

A THz photomixer emitter is disclosed. The emitter comprises a photoconductive material, an antenna structure, and an electrode array. The electrode array is disposed such that an electric field associated with photocarriers generated in the photoconductive material is coupled to the antenna for emission of a THz wave via the antenna structure. The electrode array is configured such that an electric field resonance pattern of the electrode array is substantially aligned with an emission field pattern of the antenna structure.

9 Claims, 11 Drawing Sheets

(58) Field of Classification Search
USPC ..... 250/504 R, 493.1
See application file for complete search history.

(56) References Cited

U.S. PATENT DOCUMENTS 7,092,645 B1 * 8/2006 Sternowski ..... H04B 10/25759 398/204
8,093,560 B2 * 1/2012 Kuroyanagi ..... H01Q 1/38 250/341.1
8,805,148 B2 * 8/2014 Avouris ..... G02B 6/10 385/122
2006/0152412 A1 * 7/2006 Evans ..... H01Q 3/2676 343/700 MS
2008/0023633 A1 * 1/2008 Mittleman et al. ..... 250/341.1
2008/0309577 A1 * 12/2008 Mittleman ..... G01N 21/3581 343/850
2009/0200472 A1 * 8/2009 Gregory ..... 250/339.07
2011/0080329 A1 * 4/2011 Nagel ..... H01Q 9/005 343/770
2012/0092223 A1 * 4/2012 Habib ..... H01Q 1/38 343/753

OTHER PUBLICATIONS

"International Application No. PCT/SG2011/000379, International Search Report dated Dec. 13, 2011", (dated Dec. 13, 2011), 4 pgs.
Li, Di, et al., "Investigation on Bias Electric Fields Produced by Improved Photoconductive Antenna Structures", International Workshop on Antenna Technology: Small Antennas and Novel Metamaterials, 2008. iWAT 2008., (2008), 306-309.
Winnerl, S., et al., "Terahertz vector beams", 33rd International Conference on Infrared, Millimeter and Terahertz Waves, 2008. IRMMW-THz 2008., (2008), 1-2.

* cited by examiner (a) Fig. 4 (b)

(a) (b)

THZ PHOTOMIXER EMITTER AND METHOD

PRIORITY CLAIM TO RELATED APPLICATIONS

This application is a national stage application under 35 U.S.C. §371 of PCT/SG2011/000379, filed Oct. 28, 2011, and published as WO 2012/057710 A1 on May 3, 2012, which claims priority to U.S. Application Ser. No. 61/408,099, filed Oct. 29, 2010, which applications and publication are incorporated by reference as if reproduced herein and made a part hereof in their entirety, and the benefit of priority of each of which is claimed herein.

TECHNICAL FIELD

The present invention relates broadly to a terahertz (THz) photomixer emitter and to a method of emitting a THz wave.

BACKGROUND

A THz wave falls in the electromagnetic spectrum range of around 0.1-10 THz. It has unique applications, because inter alia, its spectrum range resides in many molecular fingerprint regions. Potential applications include astronomy, wireless communications, security and safety, spectroscopy and biomedical technologies. Recent advances in THz technology have made many of these potential applications feasible. Some examples include THz imaging, spectroscopy and sensing. There are generally two types of THz wave: a pulsed T-ray and a continuous wave (CW) THz. The CW THz technology has the advantages of high spectral resolution, fast response time, tunability and low cost. However, the technology also suffers the drawbacks of low emission power, typically in the range of $<10^{-6}$ Watts preventing the technology being used for certain applications.

Present photoconductive antenna (PCA) THz photomixers usually employ an interdigitated electrode design for their active region to create photocarriers which act as current source for the planar THz antenna. The interdigitated configuration generates nano-antenna oscillation in a direction perpendicular to the dipole antenna thereby reducing the overall device efficiency. The relatively large gap between finger electrodes is also not conducive to enhancing the electric field for both the pumping light and the THz wave, while resulting in relatively large circuit capacitance that is undesirable for high frequency operation.

The above-mentioned drawbacks impede the performance and/or advancements of PCA THz photomixing emitters. In view of the forgoing, it is highly desirable to develop ways which enhance the emission power of PCA THz photomixing emitters.

SUMMARY

According to a first aspect of the invention, there is provided a THz photomixer emitter comprising: a photoconductive material; an antenna structure; and an electrode array disposed such that an electric field associated with photocarriers generated in the photoconductive material is coupled to the antenna for emission of a THz wave via the antenna structure; wherein the electrode array is configured such that an electric field resonance pattern of the electrode array is substantially aligned with an emission field pattern of the antenna structure.

Preferably, the antenna structure comprises a dipole antenna structure having opposing main electrodes for opposite biasing, and the electrode array is disposed between the main electrodes.

Preferably, the electrode array comprises two sets of finger electrodes disposed in a tip-to-tip configuration, each set electrically connected to a respective on of the main electrodes, and such that an electric field resonance direction between opposing fingers of the respective sets is the same as a favored electric field direction of the dipole antenna structure.

The tips of the respective finger electrodes can be tapered for enhancing the electric field associated with the photocarriers generated in the photoconductive material.

The electrode array can comprise two sets of electrode elements, each electrode element comprising a trunk portion connected to a respective one of the main electrodes and branch portions extending from the trunk portion, wherein the branch portions are disposed such that an electric field resonance direction between opposing branches of the respective sets is the same as the favored electric field direction of the dipole antenna structure.

Preferably, at least some of the electrode elements comprise branch portions extending in different directions from the trunk portion.

The electrode array can comprise two sets of electrode elements, wherein pairs of opposing electrode elements of the respective sets are configured in a circular electrode design.

The electrode array can comprise two sets of electrode elements, wherein pairs of opposing electrode elements of the respective sets are configured in a spiral electrode design. The antenna structure can comprise a broadband antenna. The THz wave can be circularly polarized.

According to a second aspect of the present invention, there is provided a method for emitting a THz wave, the method comprising the steps of: providing a photoconductive material; providing an antenna structure; and providing an electrode array disposed such that an electric field associated with photocarriers generated in the photoconductive material is coupled to the antenna for emission of the THz wave via the antenna structure; wherein the electrode array is configured such that an electric field resonance pattern of the electrode array is substantially aligned with an emission field pattern of the antenna structure.

BRIEF DESCRIPTION OF THE DRAWINGS

Embodiments of the invention will be better understood and readily apparent to one of ordinary skill in the art from the following written description, by way of example only, and in conjunction with the drawings, in which:

FIG. 1(*b*): schematic representation of an alternative set up of the THz photomixing system.

FIGS. 2(*c*) and (*d*) show the optical microscopic (left) and SEM (right) images of another known dipole antenna structures with interdigitated finger electrodes.

FIG. 10(*b*) shows a schematic diagram of the active region of an alternative embodiment to that of FIG. 10(*a*).

DETAILED DESCRIPTION

Embodiments relate to configurations of the active region of photomixers with a view to improve the efficiency of photoconductive antenna (PCA) terahertz (THz) photomixer and to increase the output power of such devices. A number of electrode configurations are disclosed to facilitate surface plasmon excitation to enhance the localized electromagnetic field for more efficient optical absorption of incident photons within the semiconductor regions in the electrodes gaps and more efficient THz emission.

Figure 1:
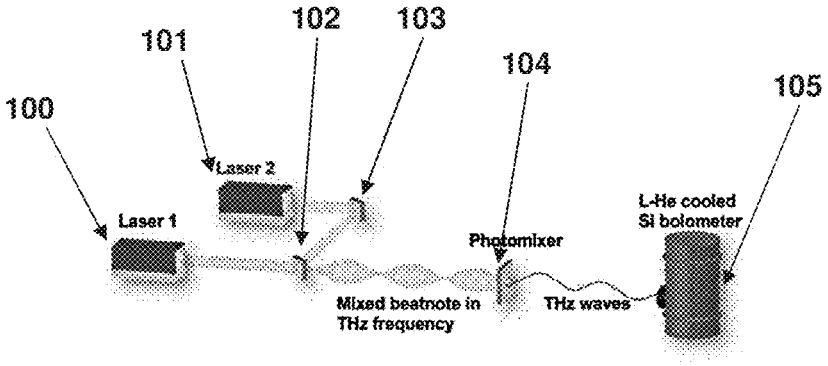
FIG. 1(*a*) shows a schematic representation of an exemplary set up of the THz photomixing system.
Figure 1:
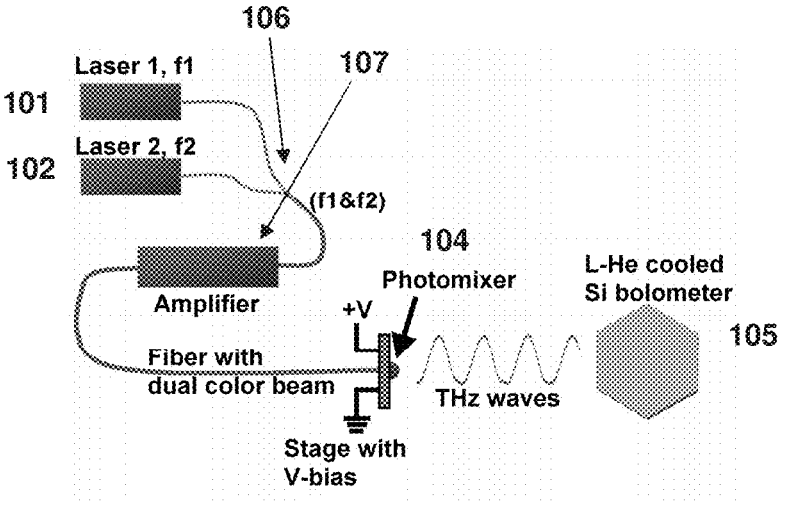

FIG. 1(*a*) shows a schematic representation of an exemplary set up of a THz photomixing system using a PCA photomixing method/system, wherein a first laser source 100 is placed behind a beam combiner 102, and a second laser source 101 is placed behind a dichroic mirror 103 respectively so that the laser beam generated by laser source 100 is directly fed to the beam combiner 102 and the laser beam generated by laser source 101 is first projected to dichroic mirror 103 and is reflected to beam combiner 102 through dichroic mirror 103. This arrangement produces waves with a mixed beatnote in the THz frequency range when beams generated by both laser sources 100 and 101 are combined and passed through beam combiner 102. The mixed beatnote waves are then allowed to pass through a CW THz photomixer 104 where continuous THz waves of uniform frequency are produced. In this way, the CW THz photomixer 104 acts as a PCA photomixing THz emitter, and the CW THz waves produced are then fed to a liquid helium cooled silicon bolometer (L-He Si bolometer) 105 where measurements can be taken. Due to the compactness of the PCA photomixing THz emitter, and its ability to operate at room temperature, it is an attractive CW THz source. It will be appreciated that the arrangement in FIG. 1 which includes the beam combiner 102 and the dichroic mirror 103 is normally used in a free space configuration. Nevertheless, waves of mixed beatnote in THz, which are to be fed to the PCA photomixing emitter, can be produced by any number of laser sources, with or without the use of beam combiner and/or dichroic mirror, or using other methods, in different embodiments. For example, FIG. 1 (*b*) provides an alternative arrangement of a THz photomixing system using fiber coupled configuration wherein a fiber coupler 106 is used to combine the waves generated by two laser sources, passed to an amplifier 107.

A CW THz photomixer 104 includes a photoconductive material on which is located an electrode array coupled to an antenna structure. A suitable photomixer can be fabricated, in one example embodiment, on low temperature (LT) grown Gallium arsenide (GaAs) which is deposited by molecular beam epitaxy (MBE) on a semi-insulating (S-I) GaAs substrate. An exemplary substrate consists of a plurality of layers including an about 50 nm thick epitaxial buffer layer of GaAs grown at about 590° C. followed by an at least about 0.5 μm thick GaAs epilayer grown at substrate temperature of about 200° C. followed by in-situ post-growth annealing at a temperature of about 600° C. for about 10 minutes. Underneath this layer, an aluminum arsenide (AlAs) heat spreading layer of >1 μm may be included to improve heat conduction. The growth conditions are designed to preferably attain a layer resistivity of >10 MOhm·cm and materials carrier lifetime of <0.6 ps. Thereafter, the substrate may be fabricated into a CW THz photomixer 104 using photolithography and electron beam lithography (EBL) processes. Planar antennas of Titanium (Ti) or Gold (Au) are deposited onto the defined openings where resonant dipoles and broadband antennas such as spiral antenna may be employed.

Figure 2:
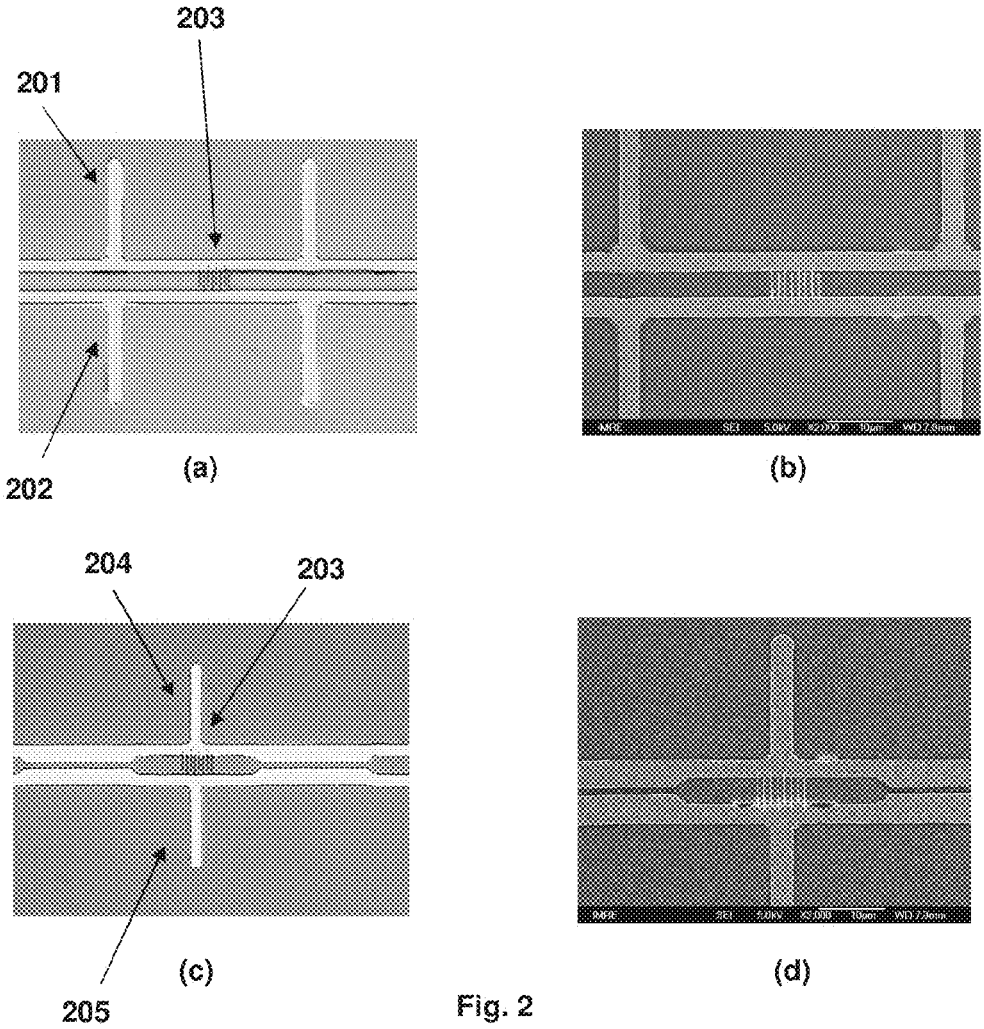
FIGS. 2(*a*) and (*b*) show the optical microscopic (left) and SEM (right) images of a known dipole antenna structures with interdigitated finger electrodes.

Two exemplary prior art CW THz photomixers having resonant dipole antenna structures 201/202, 204/205 fed by an electrode array 203 are shown in FIGS. 2(*a*), (*b*) and 2(*c*), (*d*) respectively with the pictures (a), (c) being images under optical microscope and pictures (b), (d) being images under-scanning electro-microscope (SEM).

Several factors can affect the output power of a PCA photomixing THz emitter. Amongst them are:

1. Optical pumping power and the coupling of optical power to carrier generation;
2. Antenna design, including the impedance, capacitance and conductance of the equivalent circuit. The aforesaid parameters are further related to both the electrode structure design such as dimension of the electrodes and dipoles and material properties such as carrier lifetime, mobility and resistivity;
3. Outcoupling of THz wave.

Present dipole antenna structures generally adopt sub-micron interdigitated electrodes such as those in FIGS. 2(*a*), (*b*) and (*c*), (*d*) in order to enhance the carrier generation and the electric field intensity.

Figure 3:
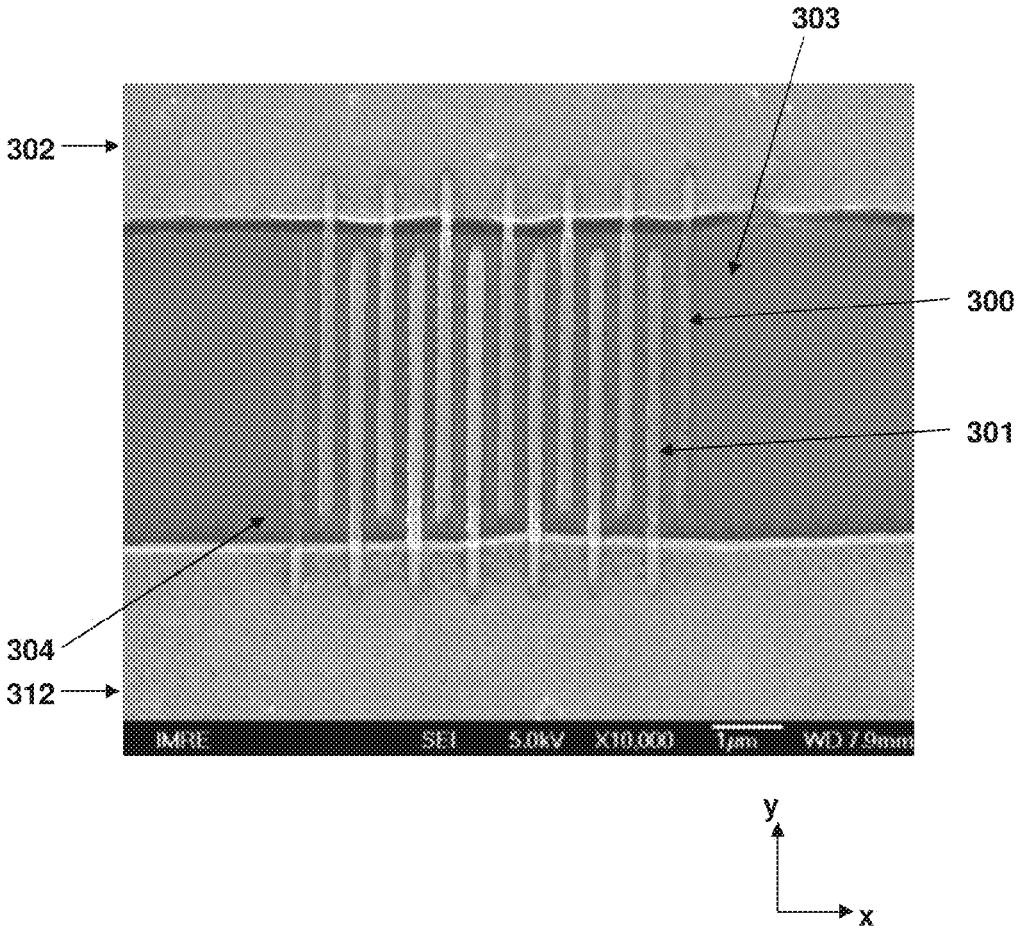
FIG. 3 shows an SEM image of the photomixer active region of the structure of FIG. 2 showing the interdigitated 100 nm-wide electrodes and the 300 nm-gap between adjacent electrodes.

FIG. 3 further shows an enlarged SEM image of an interdigitated electrodes configuration shown in FIG. 2, wherein the active region of the photomixer comprises two comb units 303, 304. The comb unit 303 further comprises a major conducting electrode 302 resembling the spine of the comb and a parallel array of nano-electrodes (finger electrodes) e.g. 300 which resemble the teeth of the comb. The two comb units 303, 304 are arranged with the finger electrodes e.g. 300, 301 sandwiched between the major conducting electrodes 302, 312 and slotted in a cross-fingered (interdigitated) manner without the tips of finger electrodes 301 touching the major conducting electrode 302 on the other comb unit 303. The major conducting electrodes 302, 312 of each comb unit 303, 304 have opposite polarities. The gap between two adjacent finger electrodes e.g. 300, 301 (inter-finger width) in the x-direction is about 300 nm. The total antenna area is of dimensions of about 5 μm×8 μm. The dipole antenna so arranged will have the THz wave emitted with the electric field preferably along the dipole direction; i.e. the y-direction of the Cartesian coordinate system shown.

Figure 4:
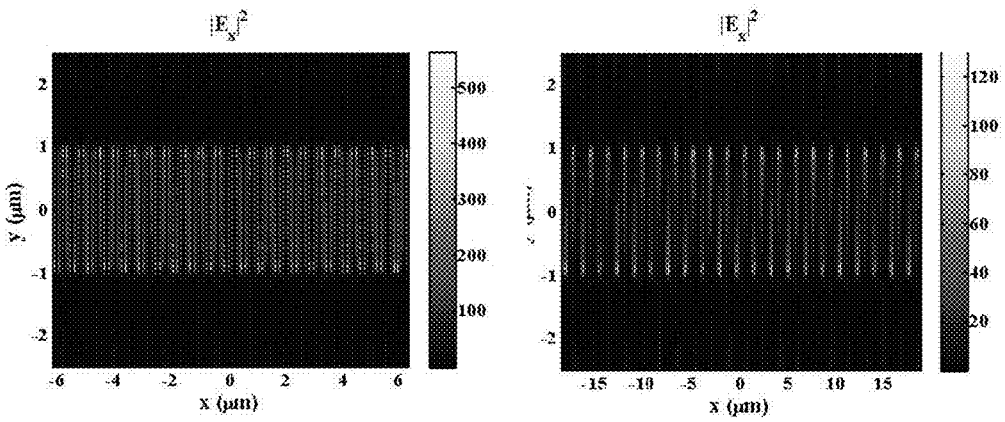
FIGS. 4(*a*) and (*b*) show the Ex field distribution in the interdigitated finger electrodes in the dipole antenna for wavelength of 300 μm THz wave for finger gap of 200 nm (left) and 800 nm (right) respectively.

Photocarriers are generated in the semiconductor surrounding the finger electrodes 300, 301 with the electrodes configuration described above. Adjacent finger electrodes 300 are biased with opposing polarity and therefore the electric field direction between adjacent finger electrodes 301 varies according to the bias polarity in either the x or −x direction. As the inter finger space decreases, plasmonic confinement becomes stronger, beneficial for both the trapping of an incident pump optical wave with wavelength of approximately 750 nm to increase photocarrier density as well as THz wave emission of wavelength greater than 300 μm. However, the enhancement of the electric field is mainly in the x-direction. This is evident from FIGS. 4(*a*), (*b*) which shows finite-difference time-domain (FDTD) simulation results of the electric field distribution in the x-direction (Ex) of the active region of the dipole antenna. The images (a), (b) were generated using parameters shown in Table 1 below.

TABLE 1

Parameters used in FDTD Simulation of interdigitated electrode configuration

| | LEFT | RIGHT |
|---|---|---|
| Width of finger electrodes (nm) | 100 | 100 |
| Length of finger electrodes (nm) | 4000 | 4000 |
| Inter-finger space (nm) | 200 | 800 |
| Wavelength (um) | 300 | 300 |
| Frequency (THz) | ~1 | ~1 |
| Thickness of major conducting electrodes (nm) | 5000 | 5000 |
| Vertical distance between major conducting electrodes (nm) | 5000 | 5000 |

Although it is clear from the simulation results that a configuration with inter-finger space of 200 nm has a much stronger Ex value than the corresponding configuration with inter-finger space of 800 nm from the grey scale accompanying the images, with the grey scale beside the image on the left having a range between 100-500 V/m and the one beside the image on the right having a range between 20-120 V/m, both designs are not satisfactory because the overall dipole structure configured according to FIG. 3 favors the THz electric field in the x-direction, while the real interest lies in enhancing the electric field in the dipole direction (i.e. y-direction) of the plasmon nano-antenna electric field. It will be appreciated that electric field is dependent on electrode configurations as well as polarization of the optical pump. With the interdigitated configuration in FIG. 3 while the electric field due to bias voltage is in the x-direction, polarization of light is also intentionally aligned to x-direction so that field enhancement in the y-direction is very weak as compared to that in the x-direction.

Figure 5:
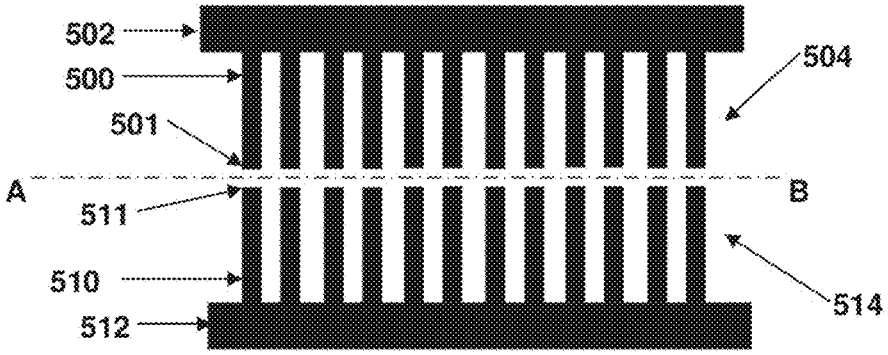
FIG. 5 shows a schematic diagram of the active region of an embodiment of the present invention having tip-to-tip configuration.

According to one embodiment of the present invention, schematically represented in FIG. 5, there is provided a nano-electrode configuration for the active region of a photomixer comprising two comb units 504, 514. The comb units 504, 514 each further comprises a major conducting electrode 502, 512 which resembles the spine of the comb and a parallel array of nano-electrodes (finger electrodes) 500, 510 resembling the teeth of the comb. The comb units 504, 514 are arranged with the tips 501, 511 of the nano-electrodes 500 on one unit of 504 pointing to but without touching the tips of the corresponding nano-electrodes 510 on the other comb unit 514, such that the two comb units 504, 514 form a mirror image of each other along an imaginary line of reflection AB. The present embodiment thus adopts a tip-to-tip orientation instead of a cross-fingered or interdigitated one for the nano-electrodes, advantageously giving rise to a much smaller cross-sectional area compared to its cross-fingered or interdigitated counterparts.

Figure 6:
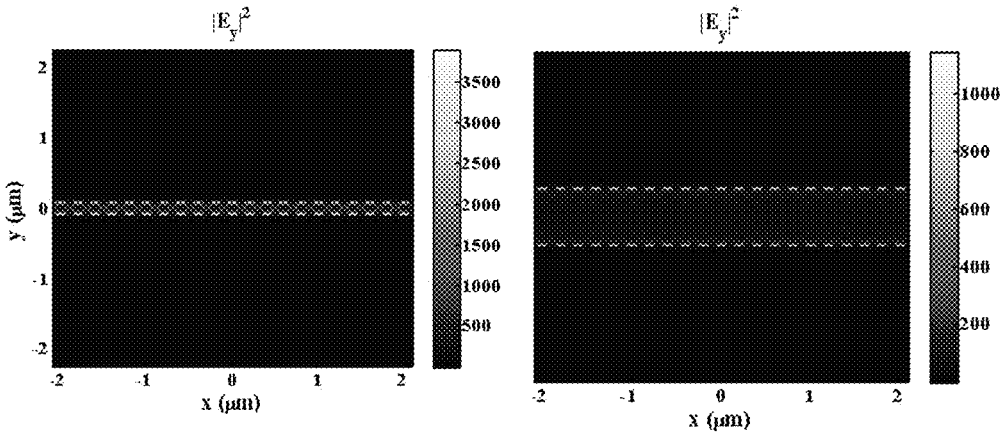
FIGS. 6(*a*) and (*b*) show the E field distribution of the active region of the embodiment of FIG. 5 for waves of wavelength of 300 μm THz and gap of 200 nm (left) and 800 nm (right) respectively.

FIGS. 6(*a*) and (*b*) show the FDTD simulation results of the electric field distribution in the y-direction (Ey) of the active region of the dipole antenna having the configuration shown in FIG. 5. The images (a), (b) were generated using parameters shown in Table 2 below.

TABLE 2

Parameters used in FDTD Simulation of tip-to-tip electrode configuration

| | Width of finger electrodes (nm) | Tip-to-tip gap (nm) | Lateral inter-finger space (nm) | Wave-length (μm) | Frequency (THz) |
|---|---|---|---|---|---|
| LEFT | 100 | 200 | 200 | 300 | 0.9 |
| RIGHT | 100 | 800 | 200 | 300 | 0.9 |

From the reading of the grey scale next to the images in FIG. 6, the field strength in the y-direction Ey with tip-to-tip gap of 200 nm (left) is in the range of 500-3500 V/m and tip-to-tip gap of 800 nm (right) is in the range of 200-1000 V/m respectively, significantly higher than the Ex counterparts obtained from the interdigitated configuration in FIG. 3 with similar inter-finger values. Also, the tip-to-tip configuration advantageously enhances an incident pumping laser beam in the visible spectrum more strongly in the tip-to-tip gap region, allowing photocarrier generation to be carried out more efficiently. The smaller cross-sectional area of a corresponding pair of nano-electrodes advantageously results in an enhanced static electric field, helpful for the photocurrent to reach the major conducting electrodes. More significantly, the preferred electric field direction of the nano-antenna is now in the y-direction, which is aligned with that of the large dipole antenna direction since the bias voltage now is in the y-direction and polarization of light intentionally aligned to the y-direction (cf. FIG. 4, where field enhancement in the x-direction here is very small as compared to that in the y-direction.) The smaller cross section of the finger tip resulting from smaller gap also advantageously reduces the capacitance of the photomixer, beneficial for high frequency operation. As would be appreciated by a person skilled in the art, all of the forgoing enhances the efficiency of a PCA THz emitter significantly.

Figure 7:
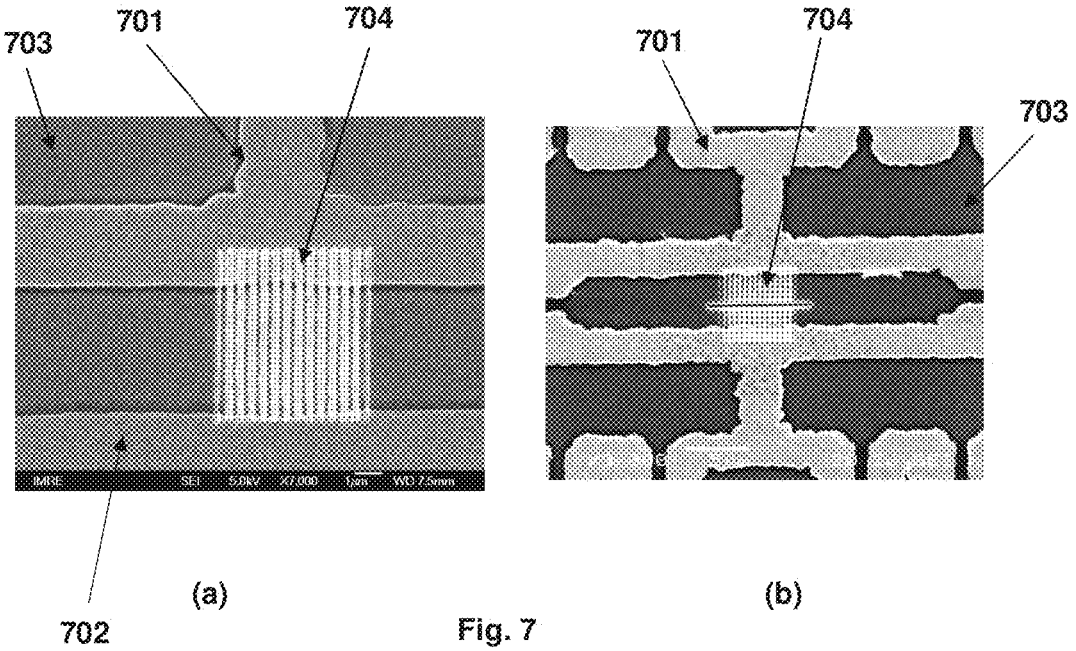
FIGS. 7(*a*) and (*b*) show SEM images of the finger electrodes in the active region of a dipole antenna before (left) and after forming the 100 nm gap at center by Focused Ion Beam (FIB) (right). The width and space of the fingers are 100 nm and 300 nm respectively. The electrodes are connected to two sides of the antenna.

FIGS. 7(*a*) and (*b*) shows the SEM images of an antenna according to the embodiment described in FIG. 5 showing the substrate 703, antenna 701, 702 and electrode array 704, wherein the array of finger electrodes with finger width about 100 nm, lateral inter-finger space of about 300 nm and tip-to-tip gap of about 100 nm were fabricated using EBL cum focused ion beam (FIB). The image (a) corresponds to the array of finger electrodes before the formation of tip-to-tip gaps and the image (b) on the right corresponds to the array of finger electrodes after formation of tip-to-tip gaps by FIB.

Figure 8:
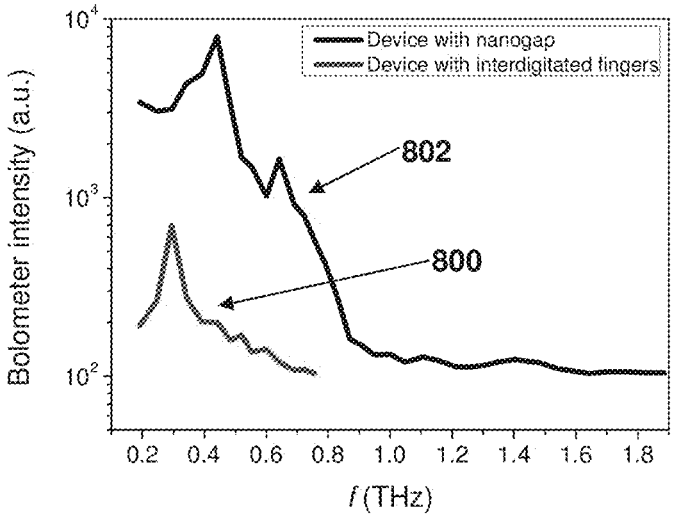
FIG. 8 shows measured continuous wave (CW) THz wave intensity spectrum of the device with tip-to-tip nanogap (black) and interdigitated electrodes (grey) respectively.

FIG. 8 shows the comparative results of two PCA photomixing THz emitters tested using the system described in FIG. 1(*a*) with THz waves coupled into a vacuum Fourier transform infrared spectroscopy (FTIR) using a Si bolometer detector. Curve 800 summarizes the field intensity distribution of the active region of the photomixer having interdigitated configuration while curve 802 summarizes the field intensity distribution of a photomixer having the tip-to-tip configuration according to the embodiment described above. It can be seen that an intensity enhancement by one order of magnitude (approximately 10 times) is achieved using the tip-to-tip configuration. Furthermore, the emission spectrum has also been broadened from about 0.2-0.8 THz for the interdigitated configuration to about 0.2-1.9 THz with the tip-to-tip configuration.

Figure 9:
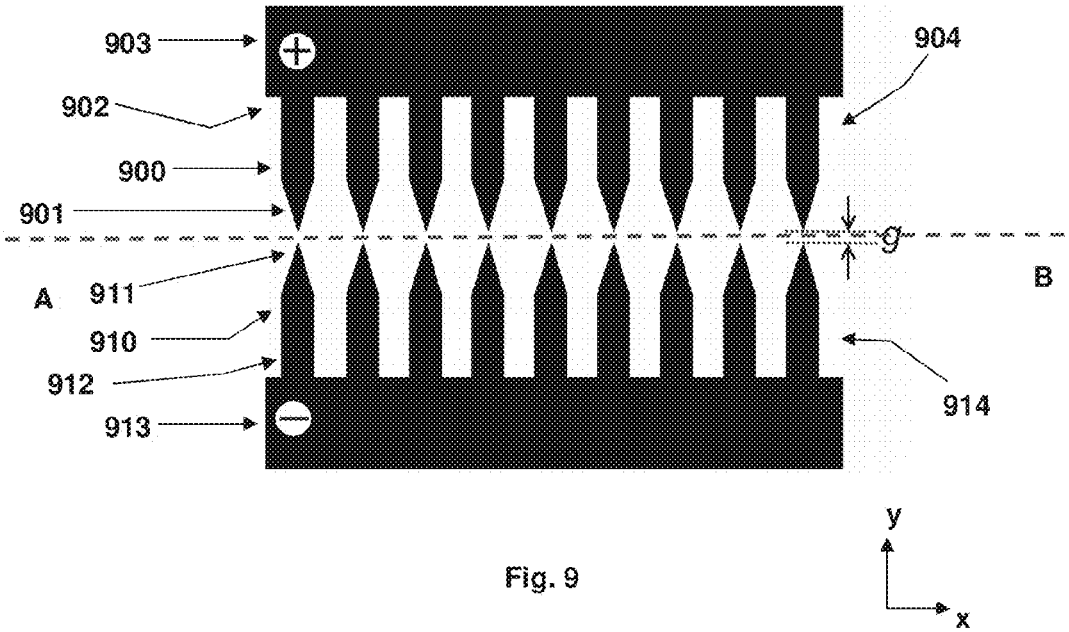
FIG. 9 shows a schematic diagram of the active region of another embodiment with sharper-tipped nano-electrodes.

According to another embodiment of the present invention, there is provided a nano-electrode configuration for the active region of a photomixer schematically represented in FIG. 9. The embodiment comprises two comb units 904, 914 wherein each comb unit 904, 914 further comprising a major conducting electrode 903, 913 resembling the spine of the comb and a parallel array of sharper-tipped nano-electrodes (finger electrodes) 900, 910 resembling the teeth of the comb. The tip 901, 911 of the sharper-tipped nano-electrode 900, 910 has a smaller cross sectional area than its base 902, 912. The two comb units 904, 914 are arranged with the tips 901 of the nano-electrodes 900 on one comb unit 904 pointing to but without touching tips 911 of the other nano-electrodes 910 on the other comb unit 914 such that the two comb units 904, 914 form a mirror image of each other along an imaginary line of reflection AB. Although the sharper-tipped nano-electrode (also known as finger electrode) 900, 910 in FIG. 9 resembles the longitudinal cross section of a tooth pick, it will be appreciated that nano-electrodes of other shapes such as elongated triangles can also be used. It will also be appreciated that the two major conducting electrodes 903, 913 have opposite polarities and need not strictly having the upper electrode carrying positive charges and the bottom one carrying negative charges.

The tip-to-tip configuration with sharper tipped nano-electrodes 910 is believed to further enhance the local electric field; the localized electric field for both pumping light and THz wave increases with decreasing cross-sectional area of the tip 901, 911 (i.e. sharper nano-electrode 900, 910), while system capacitance decreases with sharper nano-electrodes 900, 910. The sharper-tipped tip-to-tip configuration therefore advantageously allows for higher THz emission efficiency.

Taking into account device benefit as well as ease of fabrication, the following parameters given in Table 3 below may be adopted:

TABLE 3

| Exemplary dimensions for the configuration in FIG. 9 | | |
|---|---|---|
| Width of spine 1000 (nm) | Tip-to-tip gap (nm) | Lateral inter-finger space (nm) |
| <300 | <200 | <600 |

Figure 10:
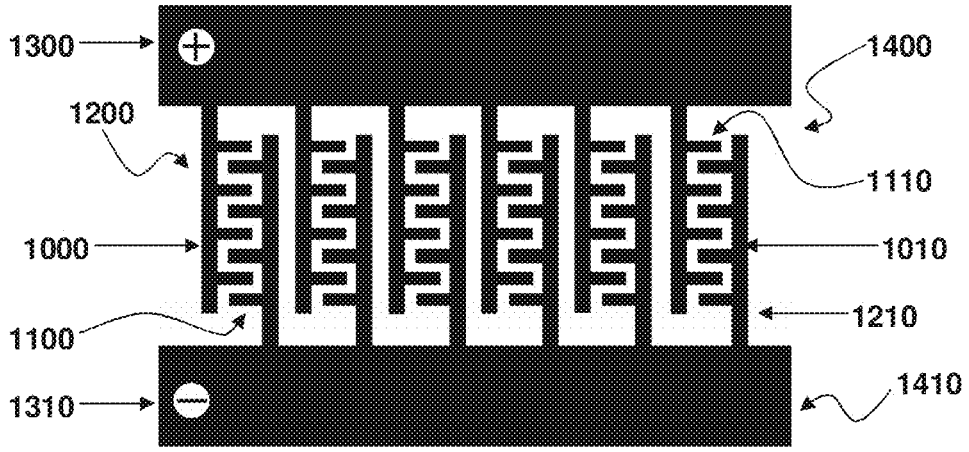
FIG. 10(*a*) shows a schematic diagram of the active region of another embodiment with comb-like nano-electrodes.
Figure 10B:
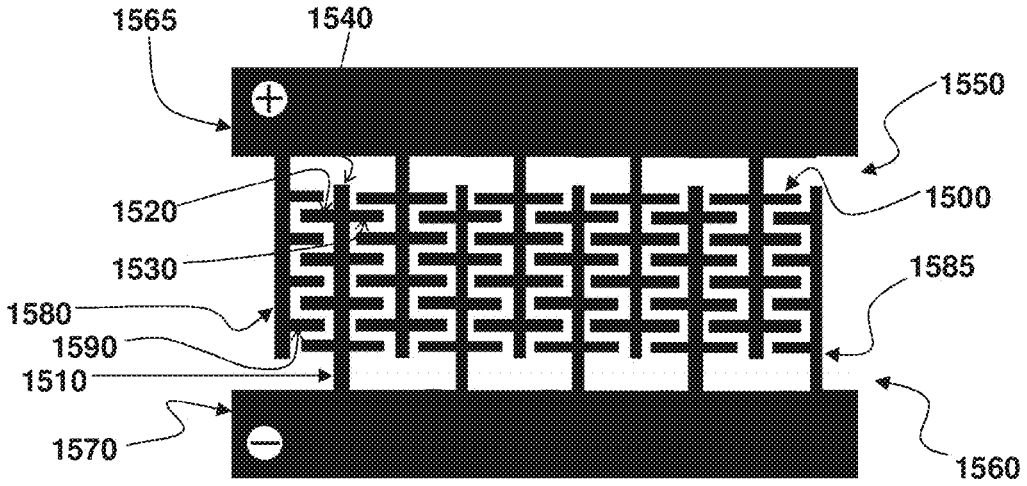

According to another embodiment of the present invention, there is provided a nano-electrode configuration for the active region of a photomixer schematically represented in FIGS. 10(*a*) and (*b*). The configuration in FIG. 10(*a*) features a double cross-fingered structure comprising two comb units 1400, 1410. Each comb unit 1400, 1410 further comprises a major conducting electrode 1300, 1310 which resembles the spine of the comb and a parallel array of comb-like nano-electrodes (finger electrodes) 1200, 1210 resembling the teeth of the comb. Each comb-like nano-electrode 1200, 1210 comprises a spine 1000, 1010 and a parallel array of teeth 1100, 1110. The two comb units 1400, 1410 are arranged to have the comb-like finger electrodes 1200, 1210 sandwiched in between the major conducting electrodes 1300, 1310 so as to form a first cross-fingered structure in the vertical direction (y-direction) among the spines 1000, 1010 of the comb-like electrodes 1200, 1210 and a second cross-fingered structure which is formed amongst the teeth 1100, 1110 of adjacent comb-like electrodes 1200, 1210 in the horizontal direction (x-direction). It will be appreciated that the two major conducting electrodes 1300, 1310 have opposite polarities and need not strictly having the upper electrode carrying positive charges and the bottom one carrying negative charges.

FIG. 10(*b*) shows an alternative double cross-fingered configuration to FIG. 10(*a*) wherein a fish-bone like nano-electrode 1500, 1510 having one array of parallel teeth 1520, 1530 on each side of the spine 1540 is introduced. The alternative configuration also comprises two comb units 1550, 1560 wherein the comb units 1550, 1560 each comprises a major conducting electrode 1565, 1570 element which resembles the spine of the comb and a parallel array of nano-electrodes resembling the teeth of the comb. The parallel array of nano-electrodes further comprises lead comb-like nano-electrodes 1580, 1585 followed by a plurality of fish-bone like nano-electrodes 1500, 1510 with the teeth 1590 of the lead comb-like nano-electrode 1580, 1585 pointing to the fish-bone like nano-electrode immediately next to it. The two comb units 1550, 1560 are again arranged to have the comb-like finger electrodes 1580 and fish-bone like nano-electrodes 1500, 1510 sandwiched in between the major conducting electrodes 1565, 1570 so as to form a first cross-fingered structure in the vertical direction (y-direction) and a second cross-fingered structure which is formed the horizontal direction (x-direction). Again, it will be appreciated that the two major conducting electrodes 1560, 1570 have opposite polarities and need not strictly having the upper electrode carrying positive charges and the bottom one carrying negative charges.

The double cross-finger configuration is believed to enhance total carrier collection area in that the there is a higher possibility that the pumping light can shine on the entire comb like nano-electrode and/or fish-bone like nano-electrode placed in between the major conducting electrodes.

Taking into account device benefit as well as ease of fabrication, the following parameters given in Table 4 below may be adopted:

TABLE 4

| Exemplary dimensions for the configuration in FIG. 10 (a) and (b) | |
|---|---|
| Width of spine (nm) | <300 |
| Gap between adjacent spines (nm) | <600 |
| Vertical gap between adjacent teeth (nm) | <200 |
| Vertical gap between major conducting electrode & tip of spine (nm) | >200 |

Figure 11:
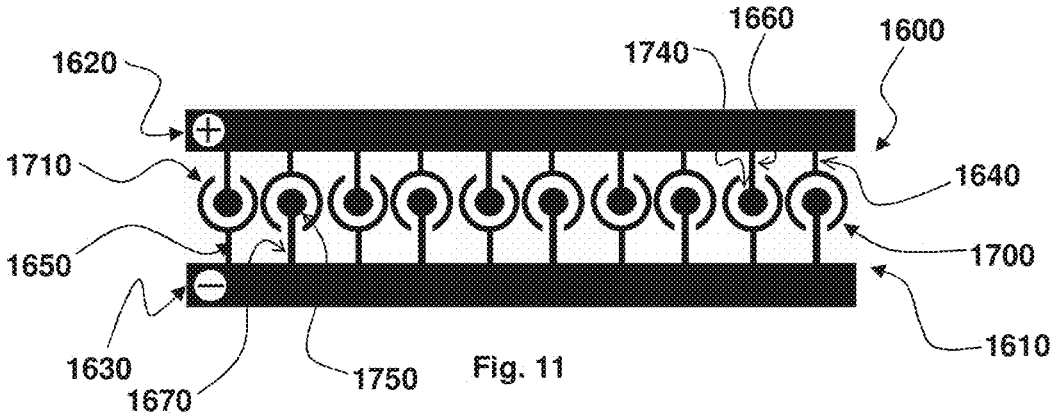
FIG. 11 shows a schematic diagram of the active region of another embodiment with circular nano-electrodes.

According to a further embodiment of the present invention, there is provided a nano-electrode configuration for the active region of a photomixer schematically represented in FIG. 11. The modified tip-to-tip configuration or circle electrode pair array pattern (also known as circular electrodes configuration) comprises two comb units 1600, 1610 wherein said comb unit 1600, 1610 further comprises a major conducting electrode 1620, 1630 resembling the spine of the comb and a parallel array of nano-electrodes (finger electrodes) resembling the teeth of the comb. The array of nano-electrodes comprises alternating open-ringed nano-electrodes 1640, 1650 and match-like nano-electrodes 1660, 1670. Said open-ringed nano-electrode 1640, 1650 comprises a stem and a C-shaped ring head 1700, 1710 with an opening configured to embrace the circular head 1740, 1750 of the match-like nano-electrodes 1660, 1670. Said match-like nano-electrode 1660, 1670 comprises a stem and a circular head 1740, 1750 configured to be embraced by open-ringed nano-electrodes 1640, 1650. The two comb units 1600, 1610 are arranged to have the open-ringed and/or match-like nano-electrodes sandwiched in between the major conducting electrodes 1620, 1630 so that the tips of nano-electrodes on one comb unit are in proximity with the tips of the nano-electrodes on the other comb unit (tip-to-tip) and that each circular head of a match-like nano-electrode on one comb unit is engulfed by the corresponding C-shaped ring head of an open-ringed nano-electrode on the other comb unit. A pair of open-ringed nano-electrode and the match-like nano-electrode so arranged can be referred to as outer and inner circular electrodes respectively. It will be appreciated that the polarities of the two major conducting electrodes 1620, 1630 are opposite; they need not strictly follow the example given in FIG. 11 wherein the upper major conducting electrode carries positive charges and the lower on carries negative charges.

Figure 12:
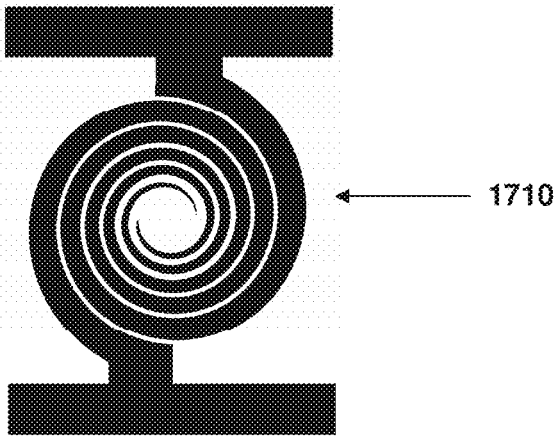
FIG. 12 shows a schematic drawing of the spiral active region of the embodiment in FIG. 11.

The above embodiment is designed with a view for broadband THz emission in combination with spiral or other types of broadband antenna. FIG. 12 shows a schematic drawing of the spiral active region 1710 of the photomixer believed to advantageously increase the effective length of electrodes for carrier capture as well as allow for emission with wider frequency range as compared to other configurations which tend to have more restrictive/specific frequency range in terms of emission. For spiral type or other broadband antenna, the emitted THz wave can have circular polarization. The smaller gap between the outer and inner circular electrodes is beneficial for aligning the electric field direction as well as enhancing local electric field. It will be appreciated that the major conducting electrode 1620, 1630 can be horizontal or spiral where the active region of the circular or spiral configuration is not linearly polarized in the x-direction or y-direction.

Taking into account device benefit as well as ease of fabrication, the following parameters given in Table 5 below may be used:

TABLE 5

| Exemplary dimensions for the configuration in FIG. 11 | |
|---|---|
| Diameter of circular head (nm) | <300 |
| Diameter of C-shaped ring head (nm) | <700 |
| Lateral gap between adjacent C-shaped ring head (nm) | <400 |
| Lateral gap between a circular head & its engulfing C-shaped ring head (nm) | <200 |

Since the total THz power emission from the antenna is related to both emission efficiency and total carrier collection area, embodiments shown in FIGS. 10(*a*), (*b*), FIG. 11 as well as variations and/or modifications thereof would allow more finger electrode pairs to be disposed in between the two major conducting electrodes while keeping the electric field between the finger electrodes primarily in the y-direction; i.e. aligned to the dipole antenna electric field direction—resulting in higher total THz emission power.

Configurations described herein, as well as any modifications and/or variations thereof can have the electric field resonance in the y-direction; i.e. aligned to the dipole antenna direction. Configurations such as tip-to-tip configuration also advantageously give rise to significantly smaller cross section of each nano-electrode thereby allowing stronger electric field confinement due to localized plasmonic effect. This further helps to enhance optical field and static field to yield better photocarrier generation with reduced circuit capacitance; all of which are beneficial to THz emission. The configurations can further advantageously enhance total area of carrier generation and hence increase total power of the device. In addition, the circular electrodes configuration is thought to be good for broadband THZ emission or circular polarized THz wave generation.

Benefits associated with the configurations include, but are not limited to, the ability to align the nano-antenna resonance direction to that of the dipole oscillation; enhanced electric field intensity in the active region of photomixers that results in higher photocarrier density and hence higher THz wave emission efficiency; i.e. improved THz output power as compared to conventional interdigitated configurations. For at least these benefits, CW THZ emitters using the configurations proposed are of significance to applications such as THz spectroscopy, THz imaging and so on.

It will be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

For example, while the embodiments have been described in the context of a CW THz wave application, it will be appreciated that the present invention is not limited to emission of CW THz waves, but can equally be applied to e.g. pulsed T-ray emission in different embodiments.

The invention claimed is:

1. A THz photomixer emitter comprising:

a photoconductive material; and a nano-scale antenna structure, the nano-scale antenna structure comprising a dipole antenna structure having opposing main electrodes for opposite biasing and an electrode array disposed between and connected to the opposing main electrodes for enhancing both an electric field associated with photocarriers generated in the photoconductive material and emission of a THz wave via the nano-scale antenna structure, wherein the electrode array comprises two sets of electrode elements, each electrode element comprising a trunk portion connected to a respective one of the main electrodes and a plurality of finger electrodes extending perpendicularly from the trunk portion for enhancing a total carrier collection area, and wherein the plurality of finger electrodes are disposed in a tip-to-tip configuration such that an electric field resonance direction between opposing fingers of the respective sets of electrode elements is the same as a favored electric field direction of the dipole antenna structure for substantially aligning the electric field resonance direction with an emission field pattern of the nano-scale antenna structure.

2. The emitter as claimed in claim 1, wherein the tips of the respective finger electrodes are tapered for enhancing the electric field associated with the photocarriers generated in the photoconductive material.

3. The emitter as claimed in claim 1, wherein each of the plurality of branch portions of each of the two sets of electrode elements has a width of two hundred nanometers or less.

4. The emitter as claimed in claim 3, wherein each of the plurality of branch portions of each of the two sets of electrode elements has a width of one hundred nanometers or less.

5. The emitter as claimed in claim 1, wherein each of the plurality of branch portions of each of the two sets of electrode elements are spaced apart from an adjoining one of the plurality of branch portions connected to the same trunk portion by a distance of six hundred nanometers or less.

6. The emitter as claimed in claim 5, wherein each of the plurality of branch portions of each of the two sets of electrode elements are spaced apart from an adjoining one of the plurality of branch portions connected to the same trunk portion by a distance of two hundred nanometers or less.

7. The emitter as claimed in claim 6, wherein each of the plurality of branch portions of each of the two sets of electrode elements are spaced apart from an adjoining one of the plurality of branch portions connected to the same trunk portion by a distance of one hundred nanometers or less.

8. The emitter as claimed in claim 1, wherein the plurality of branch portions are disposed such that a distance between opposing branches of the respective sets of electrode elements is substantially two hundred nanometers for generating the electric field resonance direction in the same direction as the favored electric field direction of the dipole antenna structure to substantially align the electric field resonance direction with an emission field pattern of the nano-scale antenna structure.

9. A THz photomixer emitter comprising:

a photoconductive material; and a nano-scale antenna structure, the nano-scale antenna structure comprising a dipole antenna structure having opposing main electrodes for opposite biasing and an electrode array disposed between the opposing main electrodes for enhancing both an electric field associated with photocarriers generated in the photoconductive material and emission of a THz wave via the nano-scale antenna structure, wherein the electrode array comprises two sets of electrode elements, each electrode element comprising a trunk portion and a plurality of branch portions extending from the trunk portion for enhancing a total carrier collection area, and wherein the plurality of branch portions of at least some of the electrode elements extend perpendicularly in different directions from the trunk portion such that an electric field resonance direction between opposing branch portions of the respective sets of electrode elements is the same as a favored electric field direction of the dipole antenna structure for substantially aligning the electric field resonance direction with an emission field pattern of the nano-scale antenna structure.

* * * * *